US007002485B1

(12) United States Patent
Werner

(10) Patent No.: US 7,002,485 B1
(45) Date of Patent: Feb. 21, 2006

(54) METHOD FOR THE QUASI-CONTINUOUS TRANSMISSION OF A TEMPORALLY MODIFIABLE VARIABLE

(75) Inventor: Burkhard Werner, Schloss Holte-Stukenbrock (DE)

(73) Assignee: Phoenix Contact GmbH & Co., Blomberg (DE)

( * ) Notice: Subject to any disclaimer, the term of this patent is extended or adjusted under 35 U.S.C. 154(b) by 665 days.

(21) Appl. No.: 10/019,868

(22) PCT Filed: Jun. 30, 2000

(86) PCT No.: PCT/DE00/02047

§ 371 (c)(1),
(2), (4) Date: Jul. 16, 2002

(87) PCT Pub. No.: WO01/03095

PCT Pub. Date: Jan. 11, 2001

(30) Foreign Application Priority Data

Jul. 3, 1999 (DE) ..... 199 30 822

(51) Int. Cl.
*G08C 19/16* (2006.01)

(52) U.S. Cl. ..... 340/870.01; 340/523

(58) Field of Classification Search ..... 340/870.01, 340/870.07, 522, 523, 679
See application file for complete search history.

(56) References Cited

U.S. PATENT DOCUMENTS

| | | | | |
|---|---|---|---|---|
| 6,157,310 | A * | 12/2000 | Milne et al. | 340/679 |
| 2004/0257269 | A1 * | 12/2004 | Laun | 342/124 |
| 2005/0180530 | A1 * | 8/2005 | Reiche | 375/317 |

FOREIGN PATENT DOCUMENTS

| | | | |
|---|---|---|---|
| DE | 43 34 980 | A1 | 4/1995 |
| DE | 197 52 948 | C1 | 3/1999 |
| WO | WO 99/13676 | A | 9/1998 |

* cited by examiner

*Primary Examiner*—Timothy Edwards, Jr.

(57) ABSTRACT

The invention relates to a method for quasi-continuous transmission of a temporally variable parameter between a transmitter and a receiver. In order to provide the time characteristic of the parameter for initiating an operationally related function, said characteristic is determined at least approximately on the basis of the transmitted information in a processing device connected downstream of the receiver.

17 Claims, 3 Drawing Sheets

METHOD FOR THE QUASI-CONTINUOUS TRANSMISSION OF A TEMPORALLY MODIFIABLE VARIABLE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a method for quasi-continuous transmission of a temporally variable parameter between a transmitting and a receiving device, and a control and data transmission system to carry out the method.

TECHNICAL FIELD

Current control and data transmission systems are used in a variety of ways for automation technology. Information is transmitted from a transmitter via a transmission medium, for example a data bus, to one or more receivers. If the temporal value of a parameter changes, the need often arises to transfer the temporally varying values of the parameter to the receiver. Since the data line is designed in many cases for the communication of a plurality of bus components, continuous data transmission between the transmitter and receiver is not generally possible, wherefore the data communication must be carried out by means of the transmission of discrete values. However, the consequence of this type of transmission, for example via an automation bus such as the field bus, is that the temporally varying parameter is present in the receiver in the form of discrete values only, and continuous transmission of a continuously varying parameter often cannot be performed without blocking the communication of other bus components with a control unit and/or with other bus components. In the case of a temporally varying parameter which is transmitted via a transmission medium to a receiver, where it is intended to initiate an operationally related function in response to its time characteristic, the problem therefore arises that no data occur between the transmission of two values of the parameters concerned.

For example, a parameter is transmitted once per second so that it does not adversely affect the general data transfer too much, i.e. block the latter. The response of the system may be delayed accordingly on the grounds of the time-discrete transmission by a variable time $\delta t$, the maximum value of which is determined by the time difference between two transmissions, i.e. is 1 second.

Furthermore, it may also be necessary, in particular for control tasks, for a sensor signal to be supplied as a control parameter with a substantially higher update rate to a controller input. However, this cannot usually be provided in a conventional manner by means of a data channel used in control and data processing systems.

One solution can be provided by routing the parameter via a direct line to the receiver, rather than via the data channel, for example a bus. However, this conflicts with the general aims of interconnecting sensors and actuators involved in a control and data processing system via the bus and controlling the system centrally. Furthermore, a cable is required between the sensor and the receiver which, for example, results in high additional cabling outlay if a plurality of positioning devices are involved and runs counter to the concept of uniform data communications via the automation bus.

SUMMARY OF THE INVENTION

The object of the invention is therefore to eliminate the indicated disadvantages of the state of the art.

This is already achieved according to the invention by a method for providing quasi-continuous transmission of a temporally variable parameter to initiate an operationally related function in a control and data transmission system, comprising the following steps: transmitting at least one element of information at discrete time intervals via a transmission medium to a receiver, and determining a time characteristic of the temporarily variable parameter at least approximately in a processing device connected downstream of the receiver, by taking account of the at least one information element, the transmitted information being a discrete value of the temporally variable parameter and the time characteristic being determined at least approximately by taking account of at least two transmitted discrete values of the temporarily variable parameter. The object of the invention is also achieved by a control and data processing system comprising a control device to control I/O components via an automation bus, a processing device, which is set up for at least approximate determination of the time characteristic of the parameter, taking account of at least two information elements transmitted via the automation bus, connected to at least one I/O component, and a device that performs an operationally related function in response to the time characteristic of the parameter.

Information is advantageously transmitted in each case at discrete time intervals via the transmission medium between the transmitter and the receiver and, in a processing device connected downstream of the receiver device, the information is used for at least approximate calculation of the time characteristic of the parameter. In a surprisingly simple manner, at least approximate values are thus obtained for each time by utilizing one of the inventive ideas of the invention, i.e. by transmitting discrete values and by approximating or determining the time characteristic of the parameter during the period between two transmissions. A typical threshold value switch or limit value switch can thus be supplied without interruption with an input signal, with no need for a separate connection to the sensor. The "determine the time characteristic of the parameter" or "determine the time when the parameter attains or exceeds a predefined value" processes are to be regarded here according to the invention as identical. It lies within the scope of the invention to transmit an individual value or a plurality of values simultaneously in an individual transmission. Furthermore, the time intervals between individual transmissions do not necessarily have to be equidistant.

If the information transmitted via the transmission medium is in each case at least one discrete value of the temporally variable parameter itself, the time characteristic of the parameter can thus be calculated in the processing device following the transmission of at least two values.

The entire multiplicity of essentially known methods, for example linear interpolation, polynomial interpolation or spline interpolation, can be used to approximate the time characteristic of the parameter under consideration. According to the invention, interpolation here designates the calculation of values of the parameter which may also lie outside the known interpolation points. The optimum interpolation method can be selected according to the expected time characteristic. Furthermore, it is also advantageously possible for the interpolation method to be modified through time with the increase in transmitted and therefore known values of the parameter, in order to achieve greater accuracy. For example, following an initial period of linear interpolation, it is possible to switch over to interpolation with cubic splines. In this way, the method can also be adapted according to the characteristic of the temporally variable parameter.

If the parameter is in a known functional relationship with time, the characteristic of the parameter can also be directly determined in the processing device if, for example an initial value has been transmitted to the processing device.

Operationally related functions can thus be initiated without interruption in response to the calculated characteristic, or the calculated parameter can be used as a continuous input parameter for a control circuit. Here, the term "operationally related function" designates all actions which may play a part in connection with the operation of an installation or machine, for example control of an actuator, recording by a sensor, but also collection and storage of data, etc.

The idea of the invention can also be used if information which is in a specific and known relationship with the time characteristic of the parameter is transferred at discrete time intervals via the bus.

Furthermore, in order to allow for a time delay in the calculation and therefore a time delay in the calculated characteristic of the parameter in relation to the actual characteristic, a time marker which essentially indicates the time of recording of the discrete value of the parameter, for example, can be transmitted simultaneously with the transmission of the discrete value of the parameter. The quantity of the transmission time which essentially causes the described delay can thus be determined and is compensated accordingly, so that ultimately the respective real-time characteristic of the parameter is available for further processing, corresponding to quasi-real-time transmission. The transmission of a time marker, for example to define a recording time, is particularly important for those systems which operate according to the collision procedure (e.g. CSMA/CD) for data transmission and therefore have no fixed bus transmission times. The individual bus transmission time for each individual transmission can thus be determined with the simultaneous transfer of the relevant time marker and can be taken into account in calculating the time characteristic of the parameter.

The method according to the invention can essentially be used in all known control and data transmission systems in which data are transferred via a common data line, but also quite generally in discrete transmissions between a transmitter and a receiver, if an action is to be initiated in a device connected downstream of the receiver in response to the time characteristic of a signal.

BRIEF DESCRIPTION OF THE DRAWINGS

The invention is explained below by describing a number of embodiments, based on the attached drawings, in which.

DETAILED DESCRIPTION OF THE INVENTION

Figure 1:
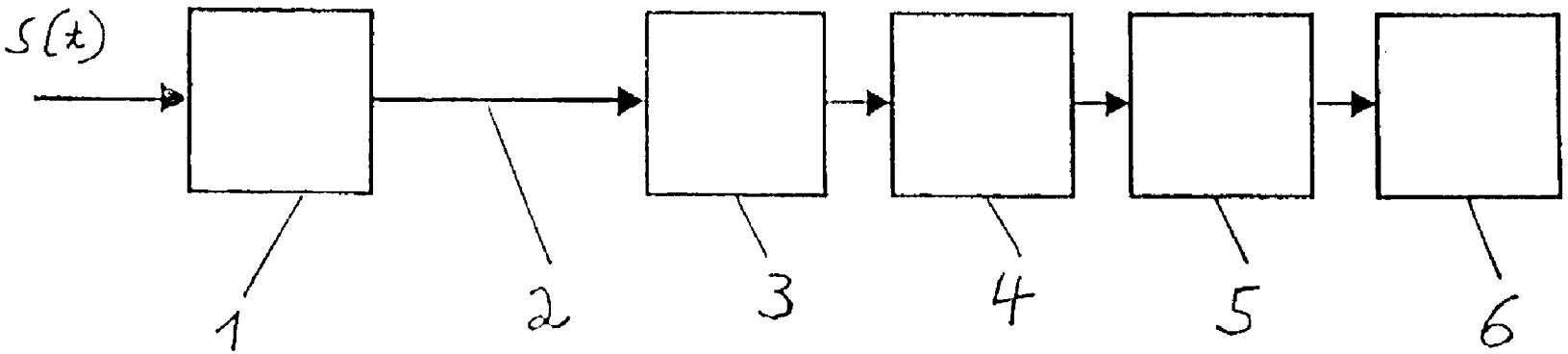
FIG. 1 is a block diagram showing a section of a basic device for carrying out the method according to the invention.

FIG. 1 shows the principle of the invention. A temporally variable parameter S=F(t) is recorded and transferred from a transmitting device 1 via a transmission medium or a transmission path 2 to a receiver device 3. This transfer is carried out at discrete time intervals, so that discrete values of the parameter S, i.e. $S(t_0)$, $S(t_1)$, $S(t_2)$, . . . $S(t_n)$ occur at the receiver 3. A processing device 4, to which the received values are in each case forwarded, is connected downstream of the receiver 3. The time characteristic of the parameter S(t) is approximated in this processing device 4 from the received discrete values by means of linear interpolation. The time characteristic, i.e. the value of the parameter under consideration at any given time, is thus available, or the time when the parameter attains a predefined value can be indicated. An operationally related function is initiated in response to the characteristic or the specified time.

Figure 2:
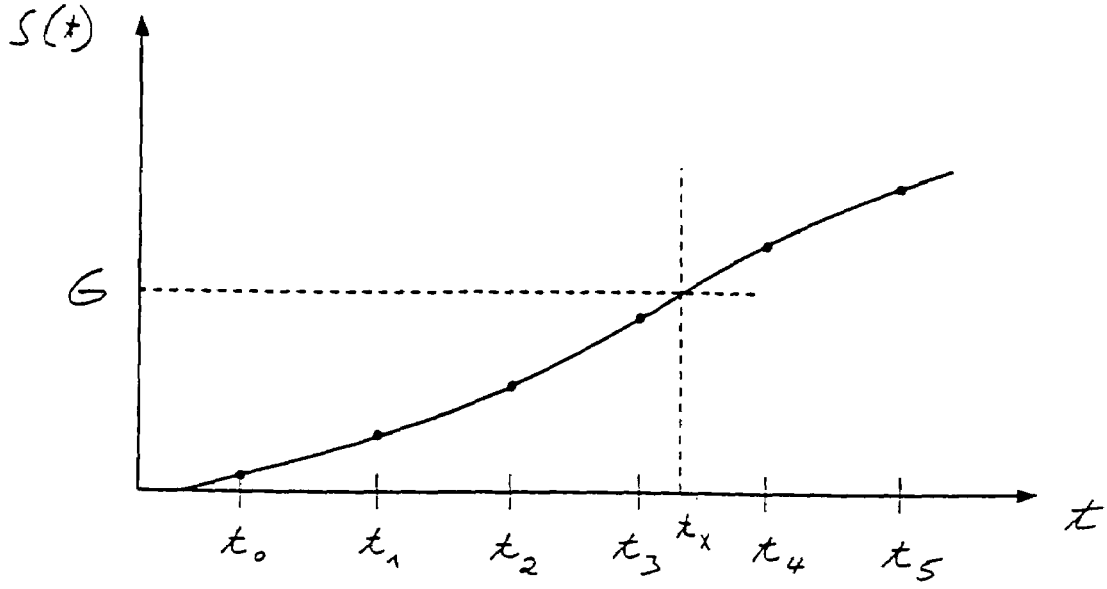
FIG. 2 shows a first example of a temporally variable parameter (FIG. 2*a*) and its approximation according to the invention (FIG. 2*b*)
Figure 2:
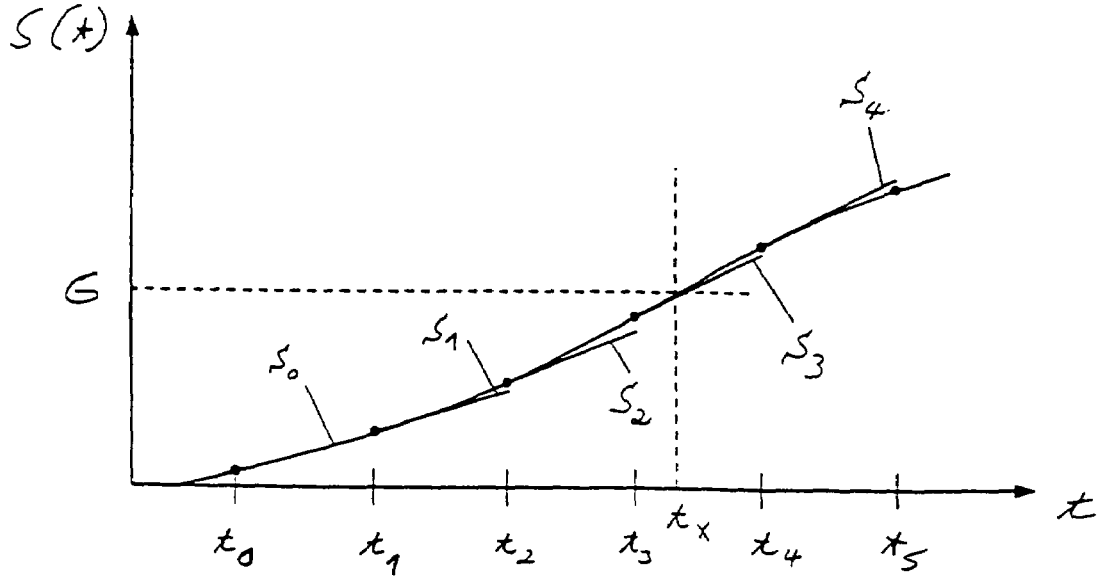

The characteristic of a typical signal in a specific embodiment of the invention is shown in FIG. 2. Here, FIG. 2*a* represents the signal S(t) of a sensor which measures the level of liquid in a container. The quantity of liquid in the container increases through time and is intended to be reduced by removing it from the container when a predefined limit G is attained. To do this, the container outlet is controlled at the predefined time. The components form part of a control and data transmission system, whereby the sensor is connected via a bus component 1 to the automation bus 2 (FIG. 1). The control of the container closure is connected via a further bus component 3 to the automation bus 2 and the central system controller. For correct functional operation, the container closure controller requires the current level of liquid in the container at all times. However, due to the principle involved, discrete level conditions $S(t_0)$, $S(t_1)$, . . . $S(t_n)$ are transmitted to the bus component of the closure controller at specific times $t_0$, $t_1$, . . . $t_n$ only. These discrete values are shown in FIG. 2*a* by dots indicating the relevant times on the curve at which the level conditions were recorded. In the present example, the temporal interval between the discrete values is 1 minute, so that the time to transmit the value via the serial field bus which is used is negligible, since the transmission times in systems of this type are typically within the millisecond range. The discrete values of the parameter S ($t_i$) received by the receiver device via the automation bus together with the actual characteristic shown in FIG. 2*b*. According to the invention, a processing device 4 which determines an approximated time characteristic from the transferred discrete values of the level conditions is connected upstream of the controller 5 of the container closure 6. In the described example, linear interpolation is carried out for this purpose, but, depending on the embodiment of the invention, higher-order polynomial interpolation, for example, or spline interpolation is also possible. The choice of interpolation is determined by the expected characteristic of the parameter which is to be approximated. The data processing of the linear interpolation which is being performed in the processing device 4 includes the steps which are to be cyclically performed in order to determine the time characteristic of the level condition:

formation of the difference between the last two received values of the level condition division of the difference calculated according to a) by the difference between the times at which the two values were received, multiplication of the result obtained according to b) by the time period elapsed since the time when the last level condition was received, and addition of the result to the last received level condition.

The values calculated in this way are shown on the continuous curve in FIG. 2*b*), which itself represents the actual characteristic, in the form of linear segments $S_0$, $S_1$, $S_2$, . . . $S_4$. This approximation is carried out cyclically until a further discrete value of the level condition occurs, this level condition defining the instantaneous value, whereupon the described approximation is restarted. A special method ensures that the transition from the approximated to the newly received level condition, in contrast to the linear segment characteristic shown in FIG. 2*b*), does not run discontinuously. The level condition characteristic generated as described is fed as an input parameter to the container closure controller. During the calculation, the last-calculated value is in each case maintained constant as a controller input parameter by means of a special hold circuit, until a newly calculated value occurs. When the predefined level condition G is attained, the closure is opened. As shown in FIG. 2*b*, the calculated level condition shown by the corresponding linear segment $S_3$ attains the limit value G approximately at time $t_x$, at which the liquid container closure is then opened. Without approximation of the time function, the closure would not take place until time $t_4$, i.e. following the transfer of the subsequent discrete level condition and therefore too late.

In a different embodiment of the invention, the processing device does not calculate the time function, but, by means of linear interpolation, the time when the predefined limit level condition G is attained. This calculation is performed in a similar manner to the calculation of the time function, and consequently requires no further explanation.

Figure 3:
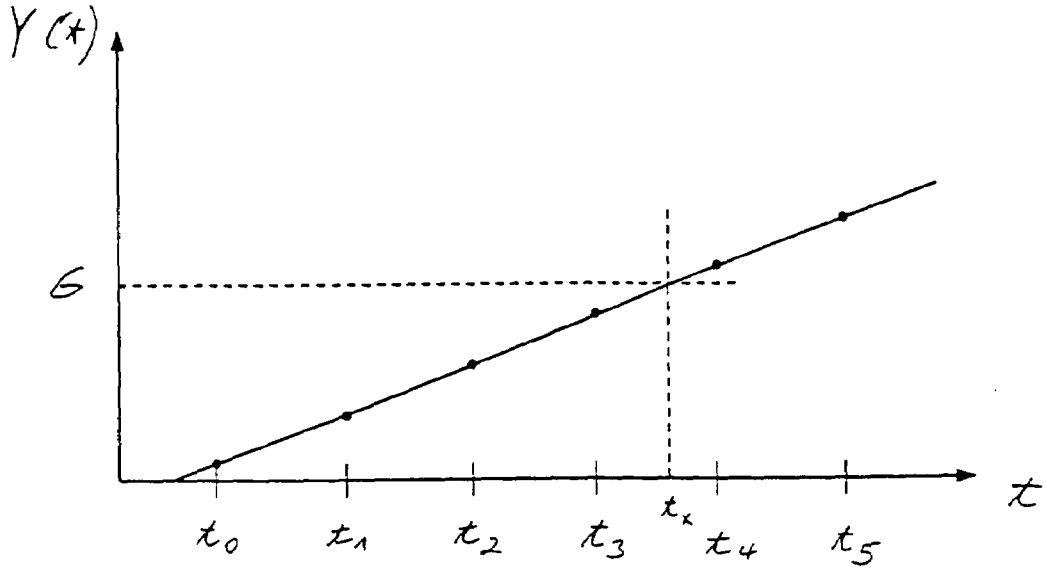
FIG. 3 shows a second example of a temporally variable parameter (FIG. 3*a*) and its approximation (FIG. 3*b*).
Figure 3:
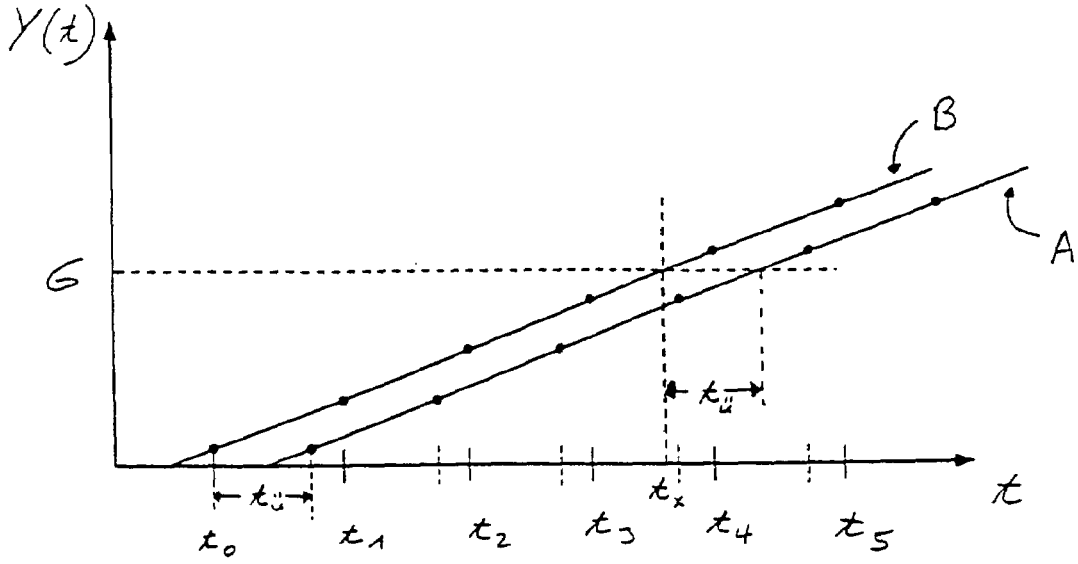

However, in other embodiments of the invention, the transmission time to transfer the discrete value of the parameter to the receiver device is not negligible. An example of this type is shown in FIG. 3. The curve shown in FIG. 3*a* describes the shift of a workpiece in one dimension by means of a drive, whereby the drive is intended to be de-activated on reaching a predefined position Y=G. Similar to the first example, the components form part of an automation system. The position sensor is connected via a bus component to a serial ring bus system according to EN 50254, via which data can be exchanged with the controller or via the controller with other bus components. The bus component allocated to the sensor transfers discrete positions $Y(t_1)$, $Y(t_2)$, . . . $Y(t_n)$ at discrete time intervals to the receiver device, to which a processing device is connected. The transmission speed and the number of bus components determine a transmission period from one bus component to the other of around 2 milliseconds. In these observations, the transmission times from the sensor to the transmitter, or possible processing times, for example to provide a digital signal at the transmitting end, and also processing times at the receiving end are not taken into account, since they are generally negligible compared with the aforementioned bus transmission time. For the example of the positioning of an object, whereby the position is recorded with a sensor and transmitted via the bus with a bus cycle time of two milliseconds to a receiver and a downstream controller, which de-activates the drive on reaching a predefined position, this means that the object has been moved by a maximum of two millimeters too far if the drive moves the object at one meter per second. However, high positioning inaccuracy of this type is unacceptable for most shift drives, for example for motherboard assembly.

FIG. 3*b* shows the time function calculated in the processing device on the curve designated by the letter A. Compared with the curve shown in FIG. 3*a*, which shows the actual characteristic of the position with the values $Y_0$, $Y_1$, . . . $Y_5$ recorded at times $t_i$ the described temporal delay corresponding to the bus transmission time $t_0$ is evident.

According to the invention, this lag in the time function compared with the actual time characteristic of the position Y of the workpiece is compensated by taking account of the bus transmission time to when calculating the time function. In the case of linear interpolation, not only the time period which has elapsed since the time when the last value was received, but also bus transmission time $t_0$ is also included as a multiplier. $t_0$ is defined, for example, either by the simultaneous transmission of a time marker, with the aid of which the transmission time is defined through comparison with a time marker on reception, or by single measurement of the bus transmission time. The single definition is frequently adequate, particularly in the case of a serial field bus system according to EN 50254, since the bus cycle time is normally constant in a system of this type.

The time function calculated in this way is shown in the curve designated as B in FIG. 3*b*. The position signal Y applied to the drive controller thus corresponds at all times to the actual sensor signal (see FIG. 3*a*), resulting in the required accurate positioning of the workpiece.

In a further embodiment, in contrast to the last embodiment, a drive parameter rather than the position itself is transferred at discrete time intervals via the bus. The position of the object can be unambiguously calculated at all times by means of this parameter. The determined relationship between the drive parameter and the position is stored in the processing device, for example in the form of an allocation table or a formula implemented by means of hardware or software. In the present example, this drive parameter is the power supplied to the drive. The displacement and therefore the position of the object can be determined via an allocation matrix stored in the processing device with a predefined supply duration of the predefined power, whereby the drive is set in such a way that it accelerates the object up to a predefined speed of 1 m/s and then maintains his speed.

What is claimed is:

1. A method for providing quasi-continuous transmission of a temporally variable parameter to initiate an operationally related function in a control and data transmission system, comprising the following steps:

transmitting at least one element of information at discrete time intervals via a transmission medium to a receiver, and determining a time characteristic of the temporarily variable parameter at least approximately in a processing device connected downstream of the receiver, by taking account of the at least one information element, the transmitted information being a discrete value of the temporally variable parameter and the time characteristic being determined at least approximately by taking account of at least two transmitted discrete values of the temporarily variable parameter.

2. The method as claimed in claim 1, wherein the transmitted information is a discrete value of a parameter, which defines the time characteristic of the temporarily variable parameter in a predefined manner, which initiates the operationally related function.

3. The method as claimed in claim 2, wherein the temporarily variable parameter defines the time characteristic of an allocation stored in the processing device.

4. The method as claimed in claim 1, wherein the time characteristic of the parameter is determined by interpolation.

5. The method as claimed in claim 4, wherein the interpolation is selected from linear installation, polynomial interpolation and spline interpolation.

6. The method as claimed in claim 1, wherein the operationally related function is initiated in response to the determined time characteristic of the temporarily variable parameter.

7. The method as claimed in claim 1, wherein the determined parameter is used as an input parameter for a control circuit.

8. The method as claimed in claim 1, wherein the operationally related function is initiated at a time $t_x$, at which the determined parameter attains at least a predefined limited value.

9. The method as claimed in claim 1, wherein the parameter is a measure of the position of an object driven to movement, and the drive is de-activated to achieve a predefined position of the object.

10. The method as claimed in claim 1, wherein a time marker is transmitted to the receiver simultaneously with the parameter or information.

11. The method as claimed in claim 1, wherein determining the time characteristic of the parameter, a time shift $t_0$ occurs which essentially corresponds to the time delay caused by the transmission of the information via the transmission medium.

12. The method as claimed in claim 2, wherein determining the time characteristic of the parameter in the period between the reception of values comprises the cyclical performance of the following steps:

a) forming the difference between the last two received or calculated values of die parameter b) dividing the difference: calculated according to step a) by the difference between the times at which the two values were received, c) adding the time period elapsed since the time when the last value of the parameter to $t_0$ was received, d) multiplying the results obtained according to steps b) and c) above, and e) adding the last obtained value or the parameter to the result calculated according to step d).

13. The method as claimed in claim 2, wherein determining the time characteristic of the temporarily variable parameter in the period between the reception of values comprises the cyclical performance of the following steps:

a) adding the time period which has elapsed since the last value was received to $t_0$ to produce a lime period $t_d$, and b) determining the instantaneous value of the parameter from the time period $t_d$ and the predefined allocation between the time period and the parameter.

14. A control and data transmission system to carry out a method as claimed in claim 1, comprising at least a control device to control I/O components via an automation bus, a processing device, which is set up for at least approximate determination of the time characteristic of the parameter, taking account of at least two information elements transmitted via the automation bus, connected to at least one I/O component, and a device that performs an operationally related function in response to the time characteristic of the parameter.

15. The control and data transmission system as claimed in claim 14, wherein the processing device comprises a logic device to carry out interpolation or regression on the basis of transmitted discrete values ($S_0$, $S_1$, . . . $S_5$) of the parameter to determine the time characteristic of the parameter.

16. The control and data transmission system as claimed in claim 14, wherein the processing device comprises a device in which an allocation of the information transmitted via the bus and a time period for the time characteristic of the parameter is stored in at least one of hardware and software implementation.

17. The control and data transmission system as claimed in claim 14, wherein a sensor records the position of a driven object, said position being discretely transmitted via the bus, and the drive is controlled in response to the determined time characteristic of the position.

* * * * *